US007228851B2

(12) United States Patent
Nakamura et al.

(10) Patent No.: US 7,228,851 B2
(45) Date of Patent: Jun. 12, 2007

(54) CANISTER HAVING ABSORBENT AND INTERNAL PURGE PUMP

(75) Inventors: Hiroshi Nakamura, Nishio (JP); Masao Kano, Gamagori (JP)

(73) Assignee: DENSO Corporation, Kariya, Aichi-pref. (JP)

( * ) Notice: Subject to any disclaimer, the term of this patent is extended or adjusted under 35 U.S.C. 154(b) by 0 days.

(21) Appl. No.: 11/484,636

(22) Filed: Jul. 12, 2006

(65) Prior Publication Data

US 2007/0012298 A1 Jan. 18, 2007

(30) Foreign Application Priority Data

Jul. 12, 2005 (JP) ..... 2005-202730

(51) Int. Cl.
*F02M 33/02* (2006.01)

(52) U.S. Cl. ..... 123/519; 123/516; 123/518; 123/520; 123/531; 123/533; 123/198 D; 73/49.7; 73/118.1

(58) Field of Classification Search ..... 123/198 D, 123/516, 518, 519, 520, 531, 533, 509; 73/49.7, 73/118.1

See application file for complete search history.

(56) References Cited

U.S. PATENT DOCUMENTS

| | | | | |
|---|---|---|---|---|
| 3,575,152 | A * | 4/1971 | Wentworth | 123/520 |
| 4,877,001 | A * | 10/1989 | Kenealy et al. | 123/519 |
| 5,139,000 | A * | 8/1992 | Sawert | 123/514 |
| 5,259,355 | A * | 11/1993 | Nakashima et al. | 123/520 |
| 5,450,833 | A * | 9/1995 | Denz et al. | 123/520 |
| 5,501,198 | A * | 3/1996 | Koyama | 123/520 |
| 5,613,477 | A * | 3/1997 | Maeda | 123/519 |
| 5,632,251 | A * | 5/1997 | Ishikawa | 123/519 |
| 5,857,446 | A * | 1/1999 | Norton | 123/520 |
| 5,992,396 | A * | 11/1999 | Krimmer et al. | 123/520 |
| 6,343,591 | B1 * | 2/2002 | Hara et al. | 123/519 |
| 6,553,976 | B1 * | 4/2003 | Threadingham et al. | 123/519 |
| 6,695,895 | B2 * | 2/2004 | Hyodo et al. | 96/111 |
| 6,736,115 | B1 * | 5/2004 | Leffel et al. | 123/519 |
| 7,096,858 | B2 * | 8/2006 | Ohhashi et al. | 123/516 |
| 2005/0011185 | A1 * | 1/2005 | Annoura et al. | 60/289 |

FOREIGN PATENT DOCUMENTS

| | | |
|---|---|---|
| JP | 2002-155812 | 5/2002 |

* cited by examiner

*Primary Examiner*—Stephen K. Cronin
*Assistant Examiner*—J. Page Hufty
(74) *Attorney, Agent, or Firm*—Nixon & Vanderhye P.C.

(57) ABSTRACT

A canister includes a casing that has a tank port connected to a fuel tank, an atmospheric port connected to an atmospheric passage communicating with atmosphere, and a purge port connected to an intake passage of an engine. An adsorbent is charged in the casing for adsorbing fuel vapor. A support member defines an accommodation chamber in the casing. The support member supports the adsorbent. A pump is supported by the support member. The pump is accommodated in the accommodation chamber. The pump introduces atmospheric air into the accommodation chamber through the atmospheric passage. A motor is accommodated in the accommodation chamber. The motor drives the pump. A damping member is located between the pump and the support member for absorbing sound and vibration transmitted from the pump to the support member.

20 Claims, 3 Drawing Sheets

CANISTER HAVING ABSORBENT AND INTERNAL PURGE PUMP

CROSS REFERENCE TO RELATED APPLICATIONS

This application is based on and incorporates herein by reference Japanese Patent Application No. 2005-202730 filed on Jul. 12, 2005.

FIELD OF THE INVENTION

The present invention relates to a canister having an absorbent. The present invention further relates to a fuel vapor treatment apparatus using the canister.

BACKGROUND OF THE INVENTION

In general, a fuel vapor treatment apparatus includes a canister that accommodates an adsorbent such as activated charcoal for adsorbing fuel vapor. Atmospheric air is introduced into the canister by a pump, which is driven using a motor, so that atmospheric air passes through the adsorbent. Fuel vapor adsorbed by the adsorbent in the canister is desorbed by suction pressure generated by intake air flow. The motor generates heat as the motor drives the pump. According to JP-A-2002-155812, a motor is-mounted in an adsorbent, so that heat generated from the motor is utilized for enhancing desorption of fuel vapor from the adsorbent.

However, in this structure, the pump driven by the motor is exposed to the outside the casing of the canister. In addition, the pump is fixed to the casing of the canister, which accommodates the adsorbent. Therefore, sound and vibration may be transmitted from the pump to the outside directly or via the canister. Consequently, sound and vibration caused in the operation of the motor and the pump may increase.

SUMMARY OF THE INVENTION

The present invention addresses the above disadvantage. According to one aspect of the present invention, a canister connects to a fuel tank. The canister connects to an engine through an intake passage. The canister connects to atmosphere through an atmospheric passage. The canister includes a casing that has a tank port, an atmospheric port, and a purge port. The tank port connects to the fuel tank. The atmospheric port connects to the atmospheric passage. The purge port connects to the intake passage. The canister further includes a support member that defines an accommodation chamber in the casing. The canister further includes an adsorbent that is charged in the accommodation chamber for adsorbing fuel vapor. The adsorbent is supported by the support member. The canister further includes a pump that is accommodated in the accommodation chamber for introducing atmospheric air into the accommodation chamber through the atmospheric passage. The pump is supported by the support member. The canister further includes a motor that is accommodated in the accommodation chamber for driving the pump. The canister further includes a damping member that is located between the pump and the support member for absorbing sound and vibration transmitted from the pump to the support member.

Alternatively, a canister connects to a fuel tank. The canister connects to an engine through an intake passage. The canister connects to atmosphere through an atmospheric passage. The canister includes a casing that has a tank port, an atmospheric port, and a purge port. The tank port connects to the fuel tank. The atmospheric port connects to the atmospheric passage. The purge port connects to the intake passage. The canister further includes a support member that defines an accommodation chamber in the casing. The canister further includes an adsorbent that is charged in the accommodation chamber for adsorbing fuel vapor. The adsorbent is supported by the support member. The canister further includes a pump that is accommodated in the adsorbent for introducing atmospheric air into the accommodation chamber through the atmospheric passage. The canister further includes a motor that is accommodated in the adsorbent for driving the pump.

A fuel vapor treatment apparatus connects to the engine through the intake passage. The fuel vapor treatment apparatus further connects to the fuel tank. The fuel vapor treatment apparatus may include the canister for absorbing fuel vapor evaporated in the fuel tank. The fuel vapor treatment apparatus may further include the atmospheric passage that connects the canister with atmosphere. The fuel vapor treatment apparatus may further include a purge passage that connects the canister with the intake passage.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
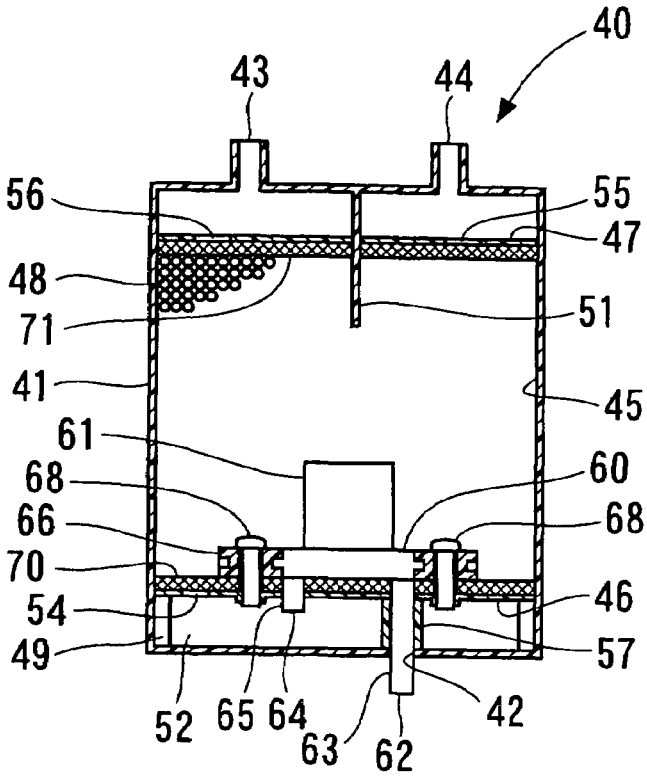
FIG. 1 is a longitudinally partially sectional view showing a canister for a fuel vapor treatment apparatus, according to a first embodiment.
Figure 3:
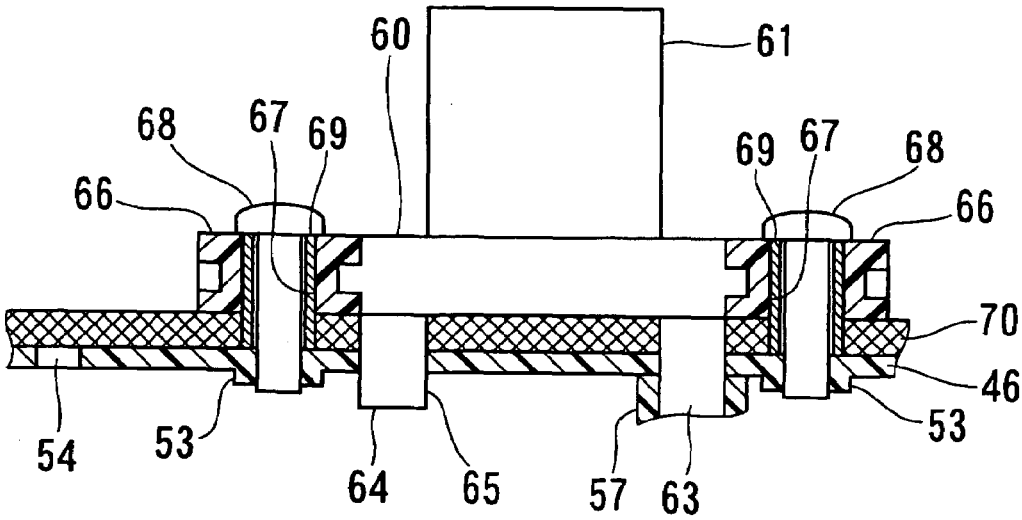
FIG. 3 is a longitudinally partially sectional view showing a pump and a motor for the fuel vapor treatment apparatus, according to the first embodiment.
Figure 2:
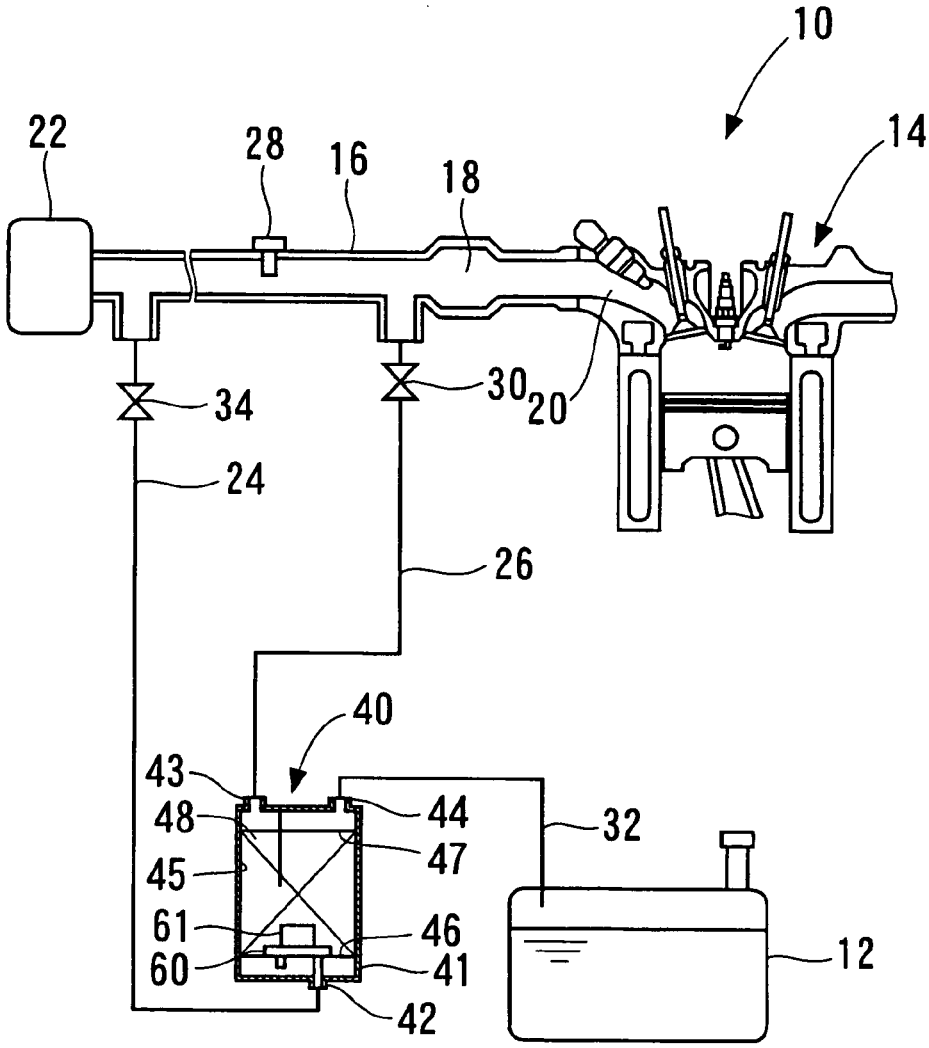
FIG. 2 is a schematic view showing the fuel vapor treatment apparatus, according to the first embodiment.

The first embodiment is described in reference to FIGS. 1 to 3. As shown in FIG. 2, a fuel vapor treatment apparatus 10 supplies fuel vapor in a fuel tank 12 of a vehicle into an intake pipe 16 of an engine 14. The fuel vapor treatment apparatus 10 includes a canister 40.

The intake pipe 16 of the engine 14 has an intake passage 18. The intake passage 18 is connected at one end thereof to an intake port 20 of the engine 14. An opposite end of the intake pipe 16 to the engine 14 connects to an air filter 22. The air filter 22 serves as an atmosphere introduction unit, which opens to the atmosphere to introduce atmospheric air into the intake passage 18, and removes foreign matters contained in atmospheric air as introduced. An atmospheric passage 24 and a purge passage 26 respectively branch from the intake passage 18. The atmospheric passage 24 branches from the downstream of the of the air filter 22 in the intake passage 18, and connects to the canister 40. The purge passage 26 branches from the downstream side of an air flow meter 28 provided to the intake pipe 16, and connects to the canister 40 via a purge valve 30.

The canister 40 includes a casing 41. The casing 41 is a vessel formed of metal or resin, for example. The casing 41 has an atmospheric port 42, a purge port 43, and a tank port 44. The atmospheric port 42 connects to the intake passage 18 through an atmospheric passage 24. The tank port 44 connects to the fuel tank 12 through a tank passage 32.

As shown in FIG. 1, the canister 40 has an accommodation chamber 45. The accommodation chamber 45 is surrounded by the casing 41, support plates 46, 47 each serving as a support member. That is, the casing 41, the support plate 46, and the support plate 47 define the accommodation chamber 45. An adsorbent 48 is charged in the accommodation chamber 45. The adsorbent 48 is composed of a particulate porous substance such as activated charcoal and silica gel. The support plate 46 is biased toward the support plate 47 using a bias member 49 such as rubber, spring, or the like. The support plate 47 is fixed to the casing 41. In this structure, the support plate 46 and the support plate 47 support the adsorbent 48 accommodated in the accommodation chamber 45, so that the support plates 46, 47 restrict the adsorbent 48 from collapsing.

The casing 41 includes a compartment wall 51 extending into the accommodation chamber 45. The compartment wall 51 extends into the adsorbent 48 charged in the accommodation chamber 45. The compartment wall 51 compartments the interior of the accommodation chamber 45 into the chamber on the side of the tank port 44 and the chamber on the side of the purge port 43. Atmospheric air containing fuel vapor flows from the fuel tank 12 into the tank port 44 of the canister 40, so that the atmospheric air is introduced to the adsorbent 48 charged in the accommodation chamber 45. Consequently, atmospheric air containing fuel vapor is restricted from shortcutting from the tank port 44 into the purge port 43.

As referred to FIG. 2, the purge port 43 of the canister 40 connects to the intake passage 18 through the purge passage 26. The purge valve 30 is provided to the purge passage 26. The purge valve 30 communicates and blocks the purge passage 26. Thereby, the purge valve 30 regulates a flow rate of atmospheric air containing fuel vapor flowing from the canister 40 into the intake passage 18.

As referred to FIG. 1, the canister 40 includes a pump 60 and a motor 61. The pump 60 includes an inlet pipe 63 and an outlet pipe 65. The inlet pipe 63 defines an inlet port 62. The outlet pipe 65 defines an outlet port 64. The pump 60 draws atmospheric air from the inlet port 62 and pressurizes the atmospheric air, thereby discharging the atmospheric air through the outlet port 64. The motor 61 may be a direct current motor (DC motor) or an alternating current motor (AC motor), for example. The motor 61 drives the pump 60. The pump 60 has a pump chamber (not shown), and includes a rotor that pressurizes atmospheric air flowing in the pump chamber. The motor 61 rotates the rotor, so that atmospheric air drawn from the inlet port 62 into the pump chamber is pressurized and discharged through the outlet port 64.

The pump 60 is formed integral with the motor 61. The inlet port 62 of the pump 60 connects to the atmospheric passage 24 through the atmospheric port 42. The outlet port 64 of the pump 60 connects to a pump passage 52 defined between the casing 41 and the support plate 46. Thereby, the pump 60 draws atmospheric air from the inlet port 62 connected to the atmospheric passage 24 (FIG. 1), pressurizes the atmospheric air, and discharges the pressurized atmosphere into the pump passage 52, to which the outlet port 64 connects.

The pump 60 is provided to the support plate 46. That is, the pump 60 is supported by the casing 41 via the support plate 46. As shown in FIGS. 1, 3, the pump 60 has the radially outward end, around which a ring 66 is provided. The ring 66 serves as an elastic body. The ring 66 is formed of a material, such as rubber and resin, having elasticity. The ring 66 is substantially annular in shape. The ring 66 is integrated with the radially outward end of the pump 60.

As shown in FIG. 3, the ring 66 has holes 67 each extending along the thickness direction of the ring 66. Bolts 68 as fixation members each provided through each hole 67 thereby extending through the ring 66. In this embodiment, bushes 69 are provided respectively through the holes 67 to protect the ring 66 from damage. The bolts 68 are respectively screwed to screwed portions 53 of the support plate 46. Thereby, the pump 60 is fixed to the support plate 46 using the bolts 68. In this example structure, each of the bolts 68 as fixation member is screwed and joined to the support plate 46 via a thread of the bolts 68. However, the pump 60 may be fixed to the support plate 46 by screwing the bolts 68 to nuts via threads. Fixation members are not limited to the bolts 68. Each fixation member may be other connecting member such as rivet, or joined pin and washer.

The canister 40 includes a filter 70 mounted between the pump 60 and the support plate 46. The filter 70 is interposed between the pump 60 and the support plate 46 such that the filter 70 covers an opening 54 formed on the support plate 46. This opening 54 communicates the pump passage 52 with the accommodation chamber 45. The support plate 46 has at least one of the opening 54. The filter 70 may be made of an aggregate of fiber such as nonwoven cloth, paper, and cloth. In addition, the filter 70 may include a mesh formed with minute openings, for example. The filter 70 restricts the adsorbent 48, which is charged in the accommodation chamber 45, from collapsing toward the pump passage 52. The filter 70 removes foreign matters contained in atmospheric air flowing from the pump passage 52 into the accommodation chamber 45.

As referred to FIG. 1, the support plate 47 is provided to the opposite side of the support plate 46 with respect to the accommodation chamber 45. The support plate 47 has openings 55, 56. The opening 55 communicates the tank port 44 with the accommodation chamber 45. The opening 56 communicates the accommodation chamber 45 with the purge port 43. Atmospheric air containing fuel vapor flows from the tank port 44 into the accommodation chamber 45 through the opening 55. In addition, atmospheric air flows from the accommodation chamber 45 into the purge port 43 through the opening 56. A filter 71 is provided to the support plate 47 such that the filter 71 overlaps the support plate 47. The filter 71 restricts the adsorbent 48, which is charged in the accommodation chamber 45, from collapsing. The filter 71 removes foreign matters contained in atmospheric air flowing from the tank port 44 into the accommodation chamber 45.

The inlet pipe 63 of the pump 60 extends through the filter 70 and the support plate 46, so that the inlet pipe 63 connects to the atmospheric passage 24 (FIG. 2). In addition, the inlet pipe 63 extends through the atmospheric port 42 formed in the casing 41. The canister 40 includes a sealing member 57 on the side of the atmospheric port 42 in the vicinity of the pump passage 52. The sealing member 57 covers the outer periphery of the inlet pipe 63 of the pump 60 thereby, sealing the pump passage 52 from the atmospheric port 42. Thus, atmospheric air discharged from the pump 60 is restricted from flowing to the outside through the connection between the casing 41 and the inlet pipe 63. In addition, the sealing member 57 provides sealing between the pump passage 52 and the atmospheric port 42. Therefore, the inlet pipe 63 and the casing 41, which forms the atmospheric port 42, may have a gap therebetween.

The pump 60 is located inside the accommodation chamber 45 such that the pump 60 is supported on the support plate 46. Therefore, peripheries of the pump 60 and the motor 61 can be covered with the adsorbent 48, which is charged in the accommodation chamber 45. Consequently, the adsorbent 48 is present between the pump 60 and the motor 61, and the casing 41, so that the pump 60 and the motor 61 can be restricted from making contact directly with the casing 41. Thereby, sound and noise caused by operation of the pump 60 and the motor 61 can be absorbed by the adsorbent 48, which surrounds the pump 60 and the motor 61, so that the sound and noise can be restricted from being transmitted to the casing 41. Consequently, the sound and noise, which are transmitted from the pump 60 and the motor 61 to the casing 41, can be reduced. Thus, the sound and noise can be restricted from being discharged outside from the casing 41.

In addition, the pump 60 is provided inside the accommodation chamber 45, so that the adsorbent 48 is heated by thermal energy generated from the motor 61 as the motor 61 drives the pump 60. As pressure becomes lower around the adsorbent 48, and as temperature becomes higher around the adsorbent 48, desorption of fuel vapor adsorbed by the adsorbent 48 is enhanced. The pump 60 is located inside the adsorbent 48 in the accommodation chamber 45, so that desorption of fuel vapor from the adsorbent 48 can be enhanced. In addition, the pump 60 and the motor 61 are covered with the adsorbent 48, so that the pump 60 and the motor 61 are not exposed to the outside of the casing 41. Therefore, the pump 60 and the motor 61 can be protected from corrosion. In addition, a sealing quality of the pump 60 can be readily secured. Therefore, any additional member for restricting corrosion and for securing the sealing quality need not be provided. Thus, the construction of the canister 40 can be simplified, and the number of components can be reduced.

In addition, the ring 66 and the filter 70 are located between the pump 60 and the support plate 46. Therefore, the ring 66 and the filter 70 are present between the pump 60 and the support plate 46, so that the pump 60 and the motor 61 can be restricted from making contact directly with the casing 41. Thereby, sound and vibration caused by the pump 60 and the motor 61 can be absorbed using the filter 70 and the ring 66, each serving as the elastic body. That is, the filter 70 and the ring 66 construct an damping member. Consequently, sound and noise transmitted from the pump 60 and the motor 61 to the casing 41 via the support plate 46 can be reduced. Therefore, sound and vibration emitted outside the casing 41 can be reduced. In addition, the filter 70 absorbs sound and vibration emitted from the pump 60 and the motor 61, so that an additional component for absorbing the sound and vibration need not be provided. Thus, the number of components can be restricted from increasing.

Further, according to this embodiment, the inlet pipe 63 of the pump 60 is not in contact with the atmospheric port 42 of the casing 41. Therefore, sound and vibration of the pump 60 and the motor 61 can be restricted from being transmitted to the casing 41 via the inlet pipe 63. Accordingly, sound and vibration emitted outside the casing 41 can be reduced.

Subsequently, an operation of the fuel vapor treatment apparatus 10 is described.

As fuel is evaporated in the fuel tank 12, pressure in the fuel tank 12 increases, so that atmospheric air containing fuel vapor flows from the fuel tank 12 into the canister 40. When the engine 14 stops, an atmospheric valve 34 provided to the atmospheric passage 24 is opened, so that the atmospheric passage 24 is communicated to the atmosphere through the air filter 22. As pressure in the fuel tank 12 increases, atmospheric air flowing out of the fuel tank 12 is discharged to the atmosphere from the canister 40 and the atmospheric passage 24 through the air filter 22. In this state, fuel vapor caused in the fuel tank 12 is introduced into the canister 40, so that the fuel vapor is adsorbed by the adsorbent 48, which is charged in the accommodation chamber 45 of the canister 40.

When the engine 14 is operated, intake air flows through the intake passage 18. Therefore, pressure on the side of the intake passage 18 decreases, so that the interior of the canister 40 connected to the intake passage 18 through the purge passage 26 is reduced in pressure. In this state, the atmospheric valve 34 is opened, and the motor 61 drives the pump 60, so that atmospheric air is introduced into the canister 40 through the air filter 22 and the atmospheric passage 24. Atmospheric air is drawn by the pump 60 through the atmospheric passage 24 to be discharged into the pump passage 52 inside the canister 40. Atmospheric air discharged into the pump passage 52 flows into the accommodation chamber 45, which is charged with the adsorbent 48, through the opening 54 of the support plate 46 and the filter 70. Atmospheric air flowing into the accommodation chamber 45 passes through the adsorbent 48, and the atmospheric air flows into the purge passage 26 through the purge port 43.

Atmospheric air passes through the adsorbent 48 in the canister 40, so that fuel vapor adsorbed by the adsorbent 48 is desorbed from the adsorbent 48. Intake air flows through the intake passage 18, so that suction pressure is generated in the intake passage 18. Therefore, fuel vapor desorbed from the adsorbent 48 flows into the purge passage 26 together with atmospheric air, which is introduced from the atmospheric passage 24. In addition, even when suction pressure in the intake passage 18 decreases, fuel vapor can be introduced into the purge passage 26 by the discharge pressure of the pump 60. The purge valve 30 communicates and blocks the purge passage 26, thereby regulating the flow rate of atmospheric air containing fuel vapor and flowing from the purge passage 26 into the intake passage 18. Atmospheric air flowing from the canister 40 into the intake passage 18 through the purge passage 26 contains fuel vapor of relatively high concentration. The purge valve 30 regulates the flow rate of atmospheric air, which is introduced from the canister 40 and mixed with intake air flowing through the intake passage 18, thereby maintaining an air-fuel ratio of intake air drawn into the engine 14 at a predetermined ratio.

As described above, according to the first embodiment, sound and vibration from the pump 60 and the motor 61 are absorbed by the adsorbent 48, the ring 66, and the filter 70. Therefore, sound and vibration transmitted from the pump 60 and the motor 61 to the casing 41 are reduced. Accordingly, sound and vibration emitted outside the casing 41 can be reduced.

Second Embodiment

Figure 4:
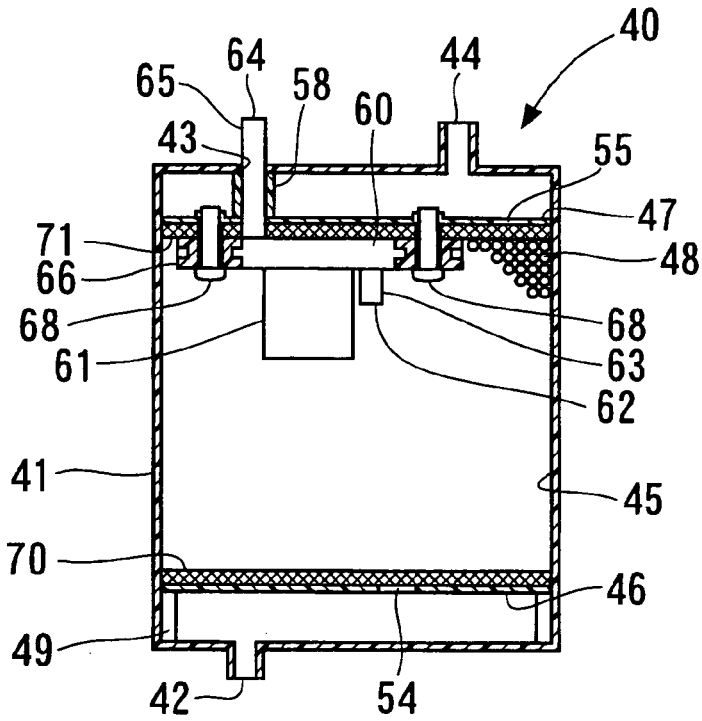
FIG. 4 is a longitudinally partially sectional view showing a canister for a fuel vapor treatment apparatus, according to a second embodiment.

According to the second embodiment, as shown in FIG. 4, the pump 60 and the motor 61 are provided to the support plate 47. The inlet port 62 of the pump 60 connects to the interior of the accommodation chamber 45 charged with the adsorbent 48. The outlet port 64 of the pump 60 connects to the purge passage 26 (FIG. 2) through the purge port 43. In this structure, the pump 60 draws atmospheric air from the inlet port 62 connected to the accommodation chamber 45, and discharges the pressurized atmosphere into the purge passage 26, to which the outlet port 64 connects.

The pump 60 is provided to the support plate 47. More specifically, the pump 60 is supported by the casing 41 via the support plate 47. The pump 60 is fixed to the support plate 47 by the bolts 68 each extending through the ring 66 in the same manner as in the first embodiment. The filter 71 is interposed between the pump 60 and the support plate 47, such that the filter 71 covers the opening 55 formed in the support plate 47. The opening 55 formed in the support plate 47 communicates the tank port 44 with the accommodation chamber 45.

The outlet pipe 65 of the pump 60 extends through the filter 71 and the support plate 47, and connects to the purge passage 26. The outlet pipe 65 extends through the purge port 43 formed in the casing 41. The outer periphery of the outlet pipe 65 is covered with the sealing member 58. The sealing member 58 provides sealing between the outlet port 64 and the purge port 43. Thereby, atmospheric air containing fuel vapor and flowing into the tank port 44 is restricted from shortcutting into the purge port 43. Therefore, the compartment wall 51, described in the first embodiment, need not be provided to the casing 41.

According to the second embodiment, the pump 60 and the motor 61 are mounted inside the accommodation chamber 45, so that the pump 60 and the motor 61 are covered with the adsorbent 48. In addition, the ring 66 and the filter 71 are interposed between the pump 60 and the support plate 47. Accordingly, sound and vibration transmitted from the pump 60 and the motor 61 to the casing 41 are decreased. Thus, sound and vibration can be restricted from being emitted to the outside.

In addition, according to the second embodiment, the inlet pipe 63 of the pump 60 communicates to the accommodation chamber 45. Atmospheric air is drawn from the accommodation chamber 45 by the pump 60, and is discharged into the purge passage 26. In this structure, when the pump 60 operates, pressure inside the accommodation chamber 45 decreases. As described above, as pressure surrounding the adsorbent 48 becomes low, desorption of fuel vapor adsorbed by the adsorbent 48 is enhanced. Therefore, according to the second embodiment, desorption of fuel vapor adsorbed by the adsorbent 48 can be further enhanced by the pump 60.

Third Embodiment

Figure 5:
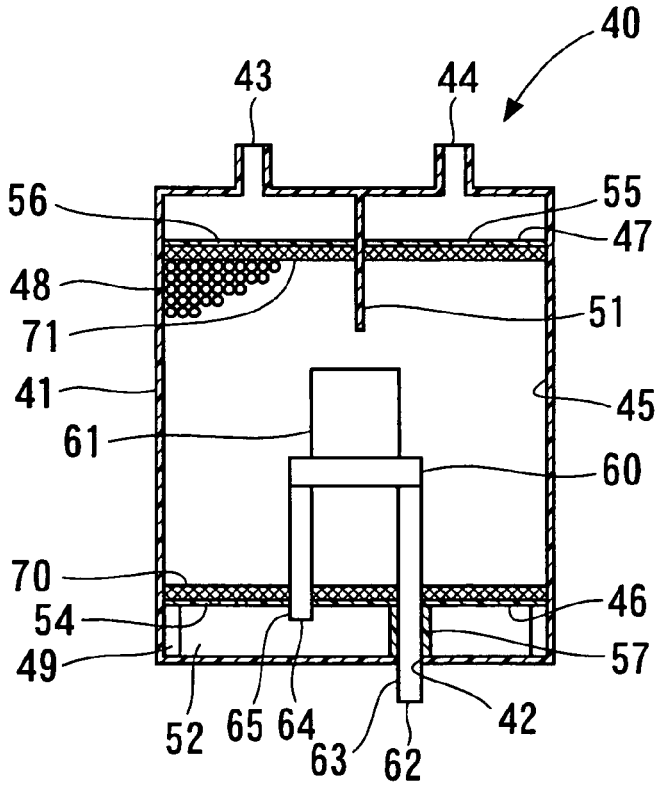
FIG. 5 is a longitudinally partially sectional view showing a canister for a fuel vapor treatment apparatus, according to a third embodiment.

According to the third embodiment, as shown in FIG. 5, the pump 60 and the motor 61 are provided inside the accommodation chamber 45, and are separated from the support plate 46. In this structure, the pump 60 and the motor 61 are substantially entirely covered with the adsorbent 48 charged in the accommodation chamber 45. The inlet pipe 63 and the outlet pipe 65 of the pump 60 are substantially entirely covered with the adsorbent 48 similarly to the pump 60 and the motor 61. The adsorbent 48 is solidly charged in the accommodation chamber 45. Therefore, the pump 60 and the motor 61 are supported by the casing 41 via the adsorbent 48 charged in the accommodation chamber 45.

According to the third embodiment, the adsorbent 48 is interposed between the pump 60 and the motor 61, and the casing 41. Therefore, sound and vibration caused from the pump 60 and the motor 61 are absorbed by the adsorbent 48. Thereby, sound and vibration transmitted to the casing 41 from the pump 60 and the motor 61 are reduced. Accordingly, sound and vibration can be restricted from being emitted to the outside.

The above structures of the embodiments can be combined as appropriate.

The invention is not limited to the embodiments described above but applicable to various embodiments within a range not departing form the gist thereof. That is, various modifications and alternations may be diversely made to the above embodiments without departing from the spirit of the present invention.

What is claimed is:

1. A canister connecting to a fuel tank, the canister connecting to an engine through an intake passage, the canister connecting to atmosphere through an atmospheric passage, the canister comprising:

a casing that has a tank port, an atmospheric port, and a purge port, the tank port connecting to the fuel tank, the atmospheric port connecting to the atmospheric passage, the purge port connecting to the intake passage;

a support member that defines an accommodation chamber in the casing;

an adsorbent that is charged in the accommodation chamber for adsorbing fuel vapor, the adsorbent being supported by the support member;

a pump that is accommodated in the accommodation chamber for introducing atmospheric air into the accommodation chamber through the atmospheric passage, the pump being supported by the support member;

a motor that is accommodated in the accommodation chamber for driving the pump; and a damping member that is located between the pump and the support member for absorbing sound and vibration transmitted from the pump to the support member.

2. The canister according to claim 1, wherein the damping member is an elastic body.

3. The canister according to claim 2, further comprising:

a fixation member that fixes the pump to the support member, wherein the elastic body is integrated with the pump, the elastic body has a hole, through which the fixation member extends, and the elastic body is interposed between the pump and the fixation member.

4. The canister according to claim 1, wherein the damping member is formed of a sheet material.

5. The canister according to claim 4, wherein the damping member is a filter for removing foreign matters contained in atmospheric air introduced into the accommodation chamber.

6. The canister according to claim 1, wherein the pump has an inlet port that connects to the atmospheric passage, and atmospheric air is drawn through the inlet port.

7. The canister according to claim 1, wherein the pump has an inlet port that connects to the accommodation chamber, and atmospheric air is drawn through the inlet port.

8. The canister according to claim 1, wherein the casing has a compartment wall that extends from the support member into the adsorbent, the compartment wall partitions the tank port from the purge port, and the tank port communicates with the purge port through the adsorbent.

9. A canister connecting to a fuel tank, the canister connecting to an engine through an intake passage, the canister connecting to atmosphere through an atmospheric passage, the canister comprising:

a casing that has a tank port, an atmospheric port, and a purge port, the tank port connecting to the fuel tank, the atmospheric port connecting to the atmospheric passage, the purge port connecting to the intake passage;

a support member that defines an accommodation chamber in the casing;

an adsorbent that is charged in the accommodation chamber for adsorbing fuel vapor, the adsorbent being supported by the support member;

a pump that is accommodated in the adsorbent for introducing atmospheric air into the accommodation chamber through the atmospheric passage; and a motor that is accommodated in the adsorbent for driving the pump.

10. The canister according to claim 9, wherein the support member supports the pump.

11. The canister according to claim 9, wherein the pump has an inlet port that connects to the atmospheric passage, and atmospheric air is drawn through the inlet port.

12. The canister according to claim 11, wherein the pump is distant from the support member, and the pump is supported by the inlet port and the adsorbent.

13. The canister according to claim 9, wherein the pump has an inlet port that connects to the accommodation chamber, and atmospheric air is drawn through the inlet port.

14. The canister according to claim 9, wherein the casing has a compartment wall that extends from the support member into the adsorbent, the compartment wall partitions the tank port from the purge port, and the tank port communicates with the purge port through the adsorbent.

15. A fuel vapor treatment apparatus connecting to an engine through an intake passage, the fuel vapor treatment apparatus connecting to a fuel tank, the fuel vapor treatment apparatus comprising:

a canister for absorbing fuel vapor evaporated in the fuel tank;

an atmospheric passage that connects the canister with atmosphere;

a purge passage that connects the canister with the intake passage, wherein the canister includes:

a casing that has a tank port, an atmospheric port, and a purge port, the tank port connecting to the fuel tank, the atmospheric port connecting to the atmospheric passage, the purge port connecting to the purge passage;

a support member that defines an accommodation chamber in the casing, an adsorbent that is charged in the accommodation chamber for adsorbing fuel vapor, the adsorbent being supported by the support member;

a pump that is accommodated in the accommodation chamber for introducing atmospheric air into the accommodation chamber through the atmospheric passage, the pump being supported by the support member;

a motor that is accommodated in the accommodation chamber for driving the pump; and a damping member that is located between the pump and the support member for absorbing sound and vibration transmitted from the pump to the support member.

16. The fuel vapor treatment apparatus according to claim 15, further comprising:

an atmospheric valve that is provided to the atmospheric passage for communicating and blocking the atmospheric passage, wherein the atmospheric valve is adapted to communicating the fuel tank with atmosphere for discharging fuel vapor from the fuel tank to the atmosphere through the canister and the atmospheric passage.

17. The fuel vapor treatment apparatus according to claim 16, further comprising:

a purge valve that is provided to the purge passage for communicating and blocking the purge passage, wherein the purge valve is adapted to regulating fuel vapor flowing from the canister into the intake passage to control an air-fuel ratio of intake air drawn into the engine through the intake passage.

18. A fuel vapor treatment apparatus connecting to an engine through an intake passage, the fuel vapor treatment apparatus connecting to a fuel tank, the fuel vapor treatment apparatus comprising:

a canister for absorbing fuel vapor evaporated in the fuel tank;

an atmospheric passage that connects the canister with atmosphere;

a purge passage that connects the canister with the intake passage, wherein the canister includes:

a casing that has a tank port, an atmospheric port, and a purge port, the tank port connecting to the fuel tank, the atmospheric port connecting to the atmospheric passage, the purge port connecting to the purge passage;

an adsorbent that is charged in the casing for adsorbing fuel vapor;

a support member that defines an accommodation chamber in the casing, the support member supporting the adsorbent;

a pump that is accommodated in the adsorbent for introducing atmospheric air into the accommodation chamber through the atmospheric passage; and a motor that is accommodated in the adsorbent for driving the pump.

19. The fuel vapor treatment apparatus according to claim 18, further comprising:

an atmospheric valve that is provided to the atmospheric passage for communicating and blocking the atmospheric passage, wherein the atmospheric valve is adapted to communicating the fuel tank with atmosphere for discharging fuel vapor from the fuel tank to the atmosphere through the canister and the atmospheric passage.

20. The fuel vapor treatment apparatus according to claim 19, further comprising:

a purge valve that is provided to the purge passage for communicating and blocking the purge passage, wherein the purge valve is adapted to regulating fuel vapor flowing from the canister into the intake passage to control an air-fuel ratio of intake air drawn into the engine through the intake passage.

* * * * *